US012121074B2

(12) United States Patent
Kirakosian

(10) Patent No.: US 12,121,074 B2
(45) Date of Patent: Oct. 22, 2024

(54) TOBACCO BOWL

(71) Applicant: Kiraco LLC, Northridge, CA (US)

(72) Inventor: Albert Kirakosian, Northridge, CA (US)

(73) Assignee: KIRACO LLC, Northridge, CA (US)

( * ) Notice: Subject to any disclaimer, the term of this patent is extended or adjusted under 35 U.S.C. 154(b) by 596 days.

(21) Appl. No.: 17/365,933

(22) Filed: Jul. 1, 2021

(65) Prior Publication Data

US 2023/0000148 A1 Jan. 5, 2023

(51) Int. Cl.
*A24F 5/00* (2006.01)
*A24F 1/30* (2006.01)

(52) U.S. Cl.
CPC . *A24F 5/00* (2013.01); *A24F 1/30* (2013.01)

(58) Field of Classification Search
CPC ..... A24F 1/30; A24F 5/00; A24F 5/10
See application file for complete search history.

(56) References Cited

U.S. PATENT DOCUMENTS

| | | | |
|---|---|---|---|
| D726,366 | S | 4/2015 | Kirakosian |
| D802,836 | S | 11/2017 | Ghiotti |
| D804,721 | S | 12/2017 | Ghiotti |
| D854,382 | S | 7/2019 | Bennett |
| D855,882 | S | 8/2019 | Flood |
| 10,383,363 | B2 | 8/2019 | Bavar |
| D901,759 | S | 11/2020 | Dinkins |
| D923,241 | S | 6/2021 | Markovic |
| D925,119 | S | 7/2021 | Kim |
| D932,235 | S | 10/2021 | Sarnoff |
| D943,188 | S | 2/2022 | Nadimi |
| D943,191 | S | 2/2022 | Kim |
| D943,192 | S | 2/2022 | Kim |
| D964,641 | S | 9/2022 | Han |
| D965,214 | S | 9/2022 | Xue |
| D968,687 | S | 11/2022 | Venable |
| D976,103 | S | 1/2023 | Zhang |
| D979,836 | S | 2/2023 | Yan |
| 2010/0275937 | A1* | 11/2010 | Shakouri Moghadam ..... A24F 1/30 131/196 |
| 2021/0360964 | A1* | 11/2021 | Bozkurt ..... A24F 1/30 |

FOREIGN PATENT DOCUMENTS

DE 202019100556 U1 * 3/2019

OTHER PUBLICATIONS

Ex Parte Quayle Action issued in related U.S. Appl. No. 29/797,687, filed Aug. 17, 2023, 6 pages.
Hookah Coal Holder Cover by: M. Rosenfeld found on Amazon (Mar. 27, 2023) https://www.amazon.com/M-ROSENFELD-Hookah-Charcoal-Holder/dp/B09XBQ3M21/ref=psdc_10342610011_t1_BOBKJWGQYP (Apr. 6, 2022).

* cited by examiner

*Primary Examiner* — Cynthia Szewczyk
(74) *Attorney, Agent, or Firm* — LEWIS ROCA ROTHGERBER CHRISTIE LLP

(57) ABSTRACT

A tobacco bowl includes a first member having a tobacco receptacle for receiving tobacco, a second member over the first member, and a coal plate for supporting a coal. The coal plate is on the second member, and the second member is moveable relative to the first member for adjusting a vertical distance between the coal place and the tobacco receptacle. The tobacco bowl may be part of a hookah. A method of using a hookah includes adjusting the distance between the coals and the tobacco.

20 Claims, 6 Drawing Sheets

TOBACCO BOWL

BACKGROUND

A hookah is a device used to smoke tobacco. The device has its origins in the Middle East and Near East regions. A typical hookah 10 as shown in FIG. 1, includes a water reservoir 12. A plug, cap or gasket 14 (either of which is referred to herein as a "cap" for illustrative purposes). The cap caps the reservoir. A stem 16 penetrates the cap such that a first end 18 of the stem is external of the reservoir whereas a second end 20 of the stem opposite the first end is within the reservoir. At least one hose 22 with optionally a mouthpiece (now shown) also penetrates the cap. To use the hookah, the reservoir is partially filled with water 25 leaving a head space 26 within the reservoir free of water while submerging the second end 20 of the stem 18 within the water. Each hose 22 extends within the head space 26 of the reservoir above the water. A tobacco bowl 28 is connected to the first end 18 of the stem. Specifically, the tobacco bowl 28 includes an opening 30 extending to its lower end for receiving the first end 18 of the stem. The tobacco bowl defines a conduit 32 extending from the opening 30 to interior of the bowl. Tobacco 31 to be smoked is placed within a tobacco support 34 defined within the bowl external of the conduit. A perforated coal plate 36 is mounted over the bowl.

Hookah tobacco, if often referred to as "massell." Massell is a mixture of tobacco, molasses, and often a flavor or fruit extract, The molasses and fruit extract add a substantial amount of moisture to the massell that is missing in conventional tobacco. This added moisture makes massell more sensitive to the elements relative to conventional tobacco. To smoke the hookah, the massell or tobacco is placed within the tobacco support 34 of the bowl. The coal plate 36 is then mounted on top of the bowl covering the massell. Typically, there is a space between the upper surface of the massell and the coal plate as it is often desirable that the coal does not contact the massell. Lit coals 37 are placed on top of the coal plate. The heat from the coals ignites the massell. Smoke generated by the ignited massell travels through the conduit and the first end of the stem and exits in the water through the second end of the stem. The water cooled the smoke exits the reservoir through each hose 22 and corresponding mouth piece as the user inhales through the mouth piece.

With existing hookahs, as the coals burn down they provide less heat and thus, lower the quality of the smoke. As a result, the coals need to be replaced often.

SUMMARY

In an example embodiment a tobacco bowl includes a first member having a tobacco receptacle for receiving tobacco, a second member over the first member, and a coal plate for supporting a coal. The coal plate is on the second member, and the second member is moveable relative to the first member for adjusting a vertical distance between the coal plate and the tobacco receptacle for adjusting a distance between the coal and the tobacco during use. In another example embodiment, the first member includes a first surface including peaks and valleys, and the second member includes a second surface including peaks and valleys such that rotation of the second member relative to the first member causes the peaks of the second surface to ride on the peaks of the first surface causing the second member to move in a direction away from the first member and the distance between the coal plate the tobacco receptacle to increase or causing the peaks of the surface of the second surface to ride in the valleys of the first surface causing the second member to move toward the first member and the distance between the coal plate and the tobacco receptacle to decrease. In a further example embodiment, each of the first and second surfaces extends along a sinusoidal path. In yet a further example embodiment, each of the first and second surfaces extends along a sawtooth path. In one example embodiment, the first surface extends to an outer surface of the first member and the second surface extends to an outer surface of the second member. In another example embodiment, the first surface is defined on a lip of the first member and the second surface is defined on a lip of the second member. In yet another example embodiment, the first member includes a first surface and the second member includes a second surface, and at least one of the first and second surfaces has at least a peak and at least a valley such that rotation of the second member relative to the first member causes the other of the first and second surfaces to ride on the at least a peak or the at least a valley for moving the first member relative to the second member for adjusting the vertical distance. In another example embodiment, the tobacco bowl further includes a cap for capping the second member. In yet another example embodiment, a reservoir is defined in the first member for receiving a coolant.

In a further example embodiment, a hookah includes a liquid reservoir, a stem extending in the liquid reservoir, a hose extending into the liquid reservoir, and a tobacco bowl extending from the step externally of the liquid reservoir. The tobacco bowl includes a first member having a tobacco receptacle for receiving tobacco, a second member over the first member, and a coal plate for supporting a coal. The coal plate is on the second member, and the second member is moveable relative to the first member for adjusting a vertical distance between the coal plate and the tobacco receptacle for adjusting a distance between the coal and the tobacco during use. In another example embodiment, the first member includes a first surface including peaks and valleys, and the second member includes a second surface including peaks and valleys such that rotation of the second member relative to the first member causes the peaks of the second surface to ride on the peaks of the first surface causing the second member to move in a direction away from the first member and the distance between the coal plate the tobacco receptacle to increase or causing the peaks of the surface of the second surface to ride in the valleys of the first surface causing the second member to move toward the first member and the distance between the coal plate and the tobacco receptacle to decrease. In a further example embodiment, each of the first and second surfaces extends along a sinusoidal path. In yet a further example embodiment, each of the first and second surfaces extends along a sawtooth path. In one example embodiment, the first surface extends to an outer surface of the first member and the second surface extends to an outer surface of the second member. In another example embodiment, the first surface is defined on a lip of the first member and the second surface is defined on a lip of the second member. In yet another example embodiment, the first member includes a first surface and the second member includes a second surface, and at least one of the first and second surfaces has at least a peak and at least a valley such that rotation of the second member relative to the first member causes the other of the first and second surfaces to ride on the at least a peak or the at least a valley for moving the first member relative to the second member for adjusting the vertical distance. In another example embodiment, the tobacco bowl further includes a cap for capping its second member. In yet another example embodiment, a reservoir is defined in the first member for receiving a coolant.

In yet another example embodiment, a method of using a hookah is provided. The hookah includes a tobacco bowl including a first member having a tobacco receptacle containing tobacco therein, and a second member over the first member. The second member has a coal plate supporting a coal. The method includes adjusting a distance of the coal to the tobacco by moving the second member relative to the first member. In a further example embodiment, moving the second member toward the first member includes rotating the second member relative to the first member. In one example embodiment, the first member includes a first surface, and the second member includes a second surface. The first surface includes a plurality of peaks and valley and the second surface includes a plurality of peaks and valleys, such that rotating the second member relative to the first member causes the peaks of the second surface to ride on the peaks of the first surface causing the second member to move in a direction away from the first member and the distance between the coal and the tobacco to increase or causes the peaks of the second surface to ride in the valleys of the first surface causing the second member to move toward the first member and the distance between the coal and the tobacco receptacle to decrease. In another example embodiment, the first member includes a first surface, and the second member includes a second surface. At least one of the first and second surfaces includes at least a peak and at least a valley, such that rotating the second member relative to the first member causes the other of the first and the second surfaces to ride on the at least a peak or the at least a valley for adjusting the distance. In yet a further example embodiment, the method further includes filling a reservoir defined in the first member with a coolant.

DETAILED DESCRIPTION

Figure 1:
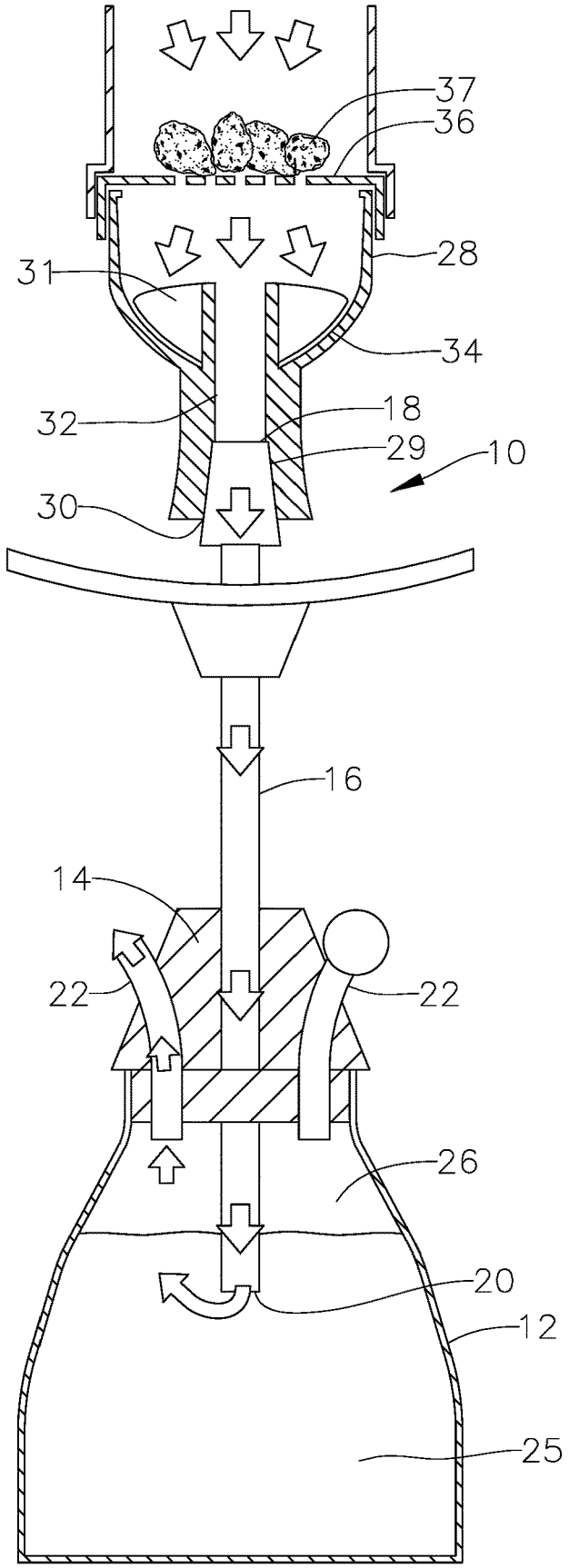
FIG. 1 PRIOR ART
FIG. 1 is a front view of a hookah including a tobacco bowl of the prior art.
Figure 2:
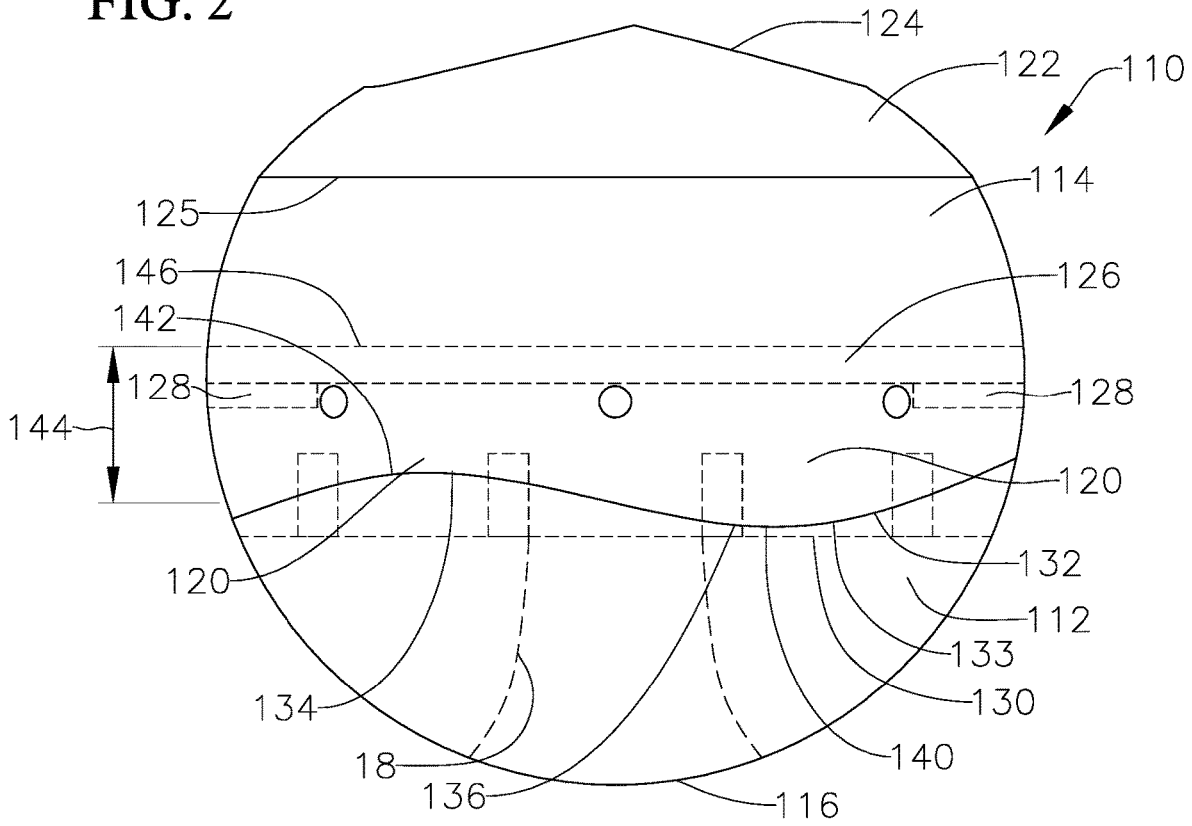
FIG. 2 is a front partial cross-sectional view of an example embodiment tobacco bowl.
Figure 3:
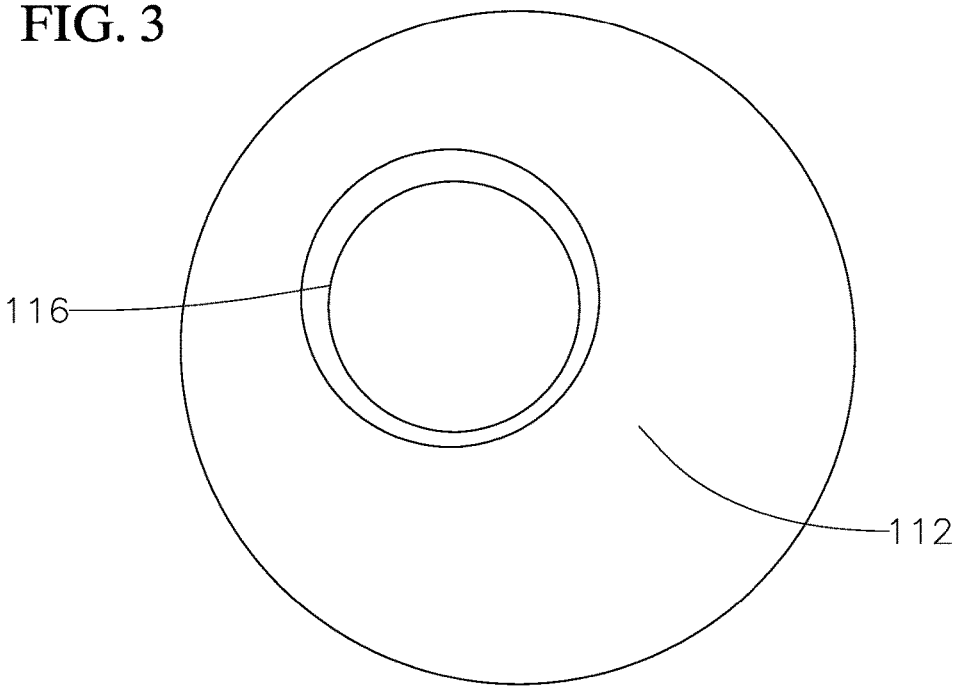
FIG. 3 is a bottom end view of the example embodiment tobacco bowl shown in FIG. 2.
Figure 4:
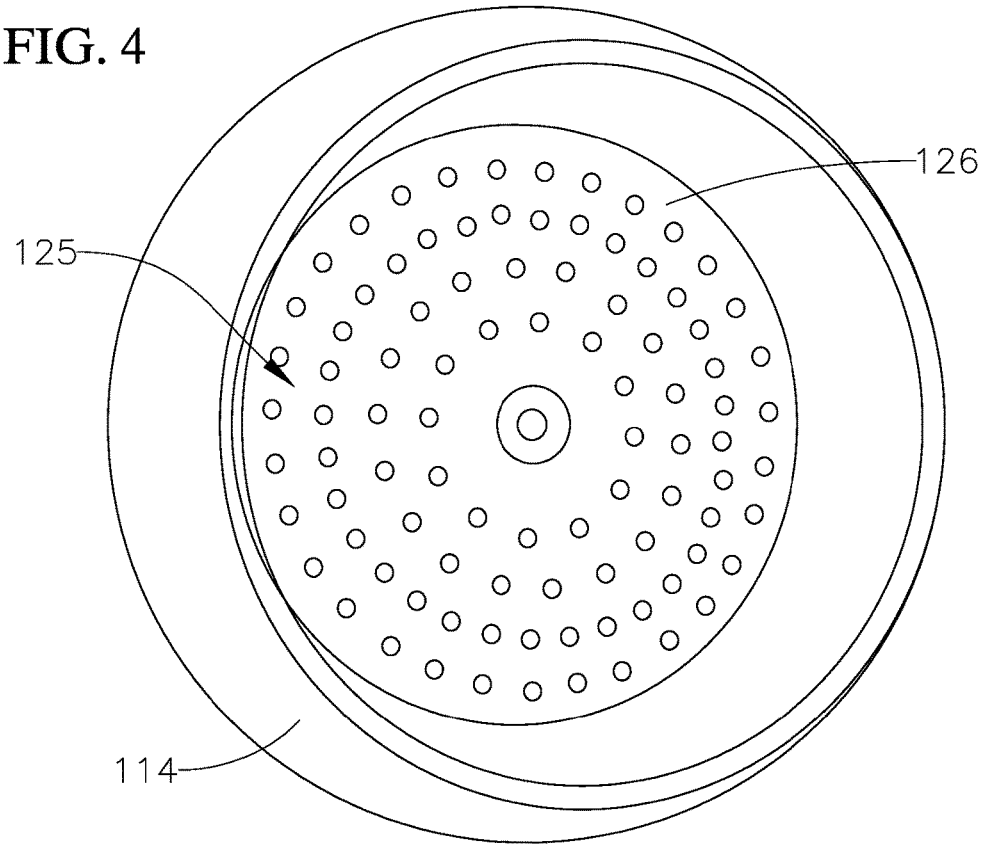
FIG. 4 is a top view of the example embodiment tobacco bowl shown in FIG. 2 with a cover of its upper member removed.
Figure 5:
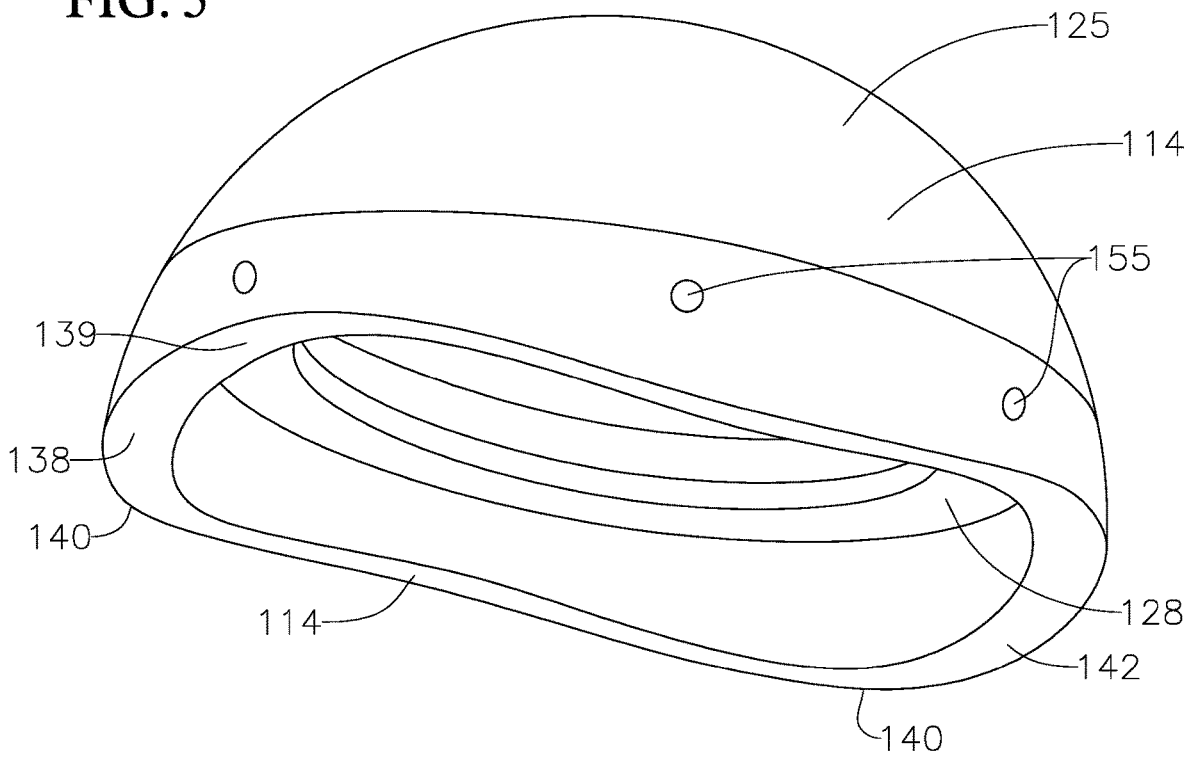
FIG. 5 is a perspective view of the upper member of the example embodiment tobacco bowl shown in FIG. 2.

In an example embodiment a hookah bowl 110 is provided that can be used with any hookah (FIG. 2). The hookah bowl in an exemplary embodiment has a lower member 112 and an upper member 114. The lower member has a section for interfacing with a hookah stem (16, FIG. 1). In the shown exemplary embodiment, the section for interfacing with the hookah stem is an opening 116 for receiving the stem, as for example shown in FIG. 3. In another example embodiment, the section can be an annular member extending from the lower portion of the lower member that is received within the stem or that receives the stem 16 of the hookah. A conduit 118 is formed inside the lower member defining a receptacle 120 around the conduit and surrounded by a peripheral wall 121 for receiving the tobacco (e.g., massell), as for example shown in FIG. 6. The conduit extends from the opening 116. The upper member may optionally include a cover 122 having a vent opening 124 for covering a top opening 125 of the upper member. The cover is removable providing access to a coal plate 126. The coal plate 126 is supported on one or more inner peripheral projections 128 extending radially within the interior of the upper member 114. In an example embodiment, a single peripheral projection 128 extends along a majority or the entire periphery of the interion of the upper member, as for example shown in FIG. 5. The peripheral projection supports the coal plate 122, as for example shown in FIGS. 2 and 5. The coal plate is plate preferably made of metal and perforated for supporting the coals used to ignite the massell. In an example embodiment, the upper member is couplable with the lower member such that a vertical distance 144 of the coal plate from a base 130 of the receptacle 120 may be varied.

Figure 6:
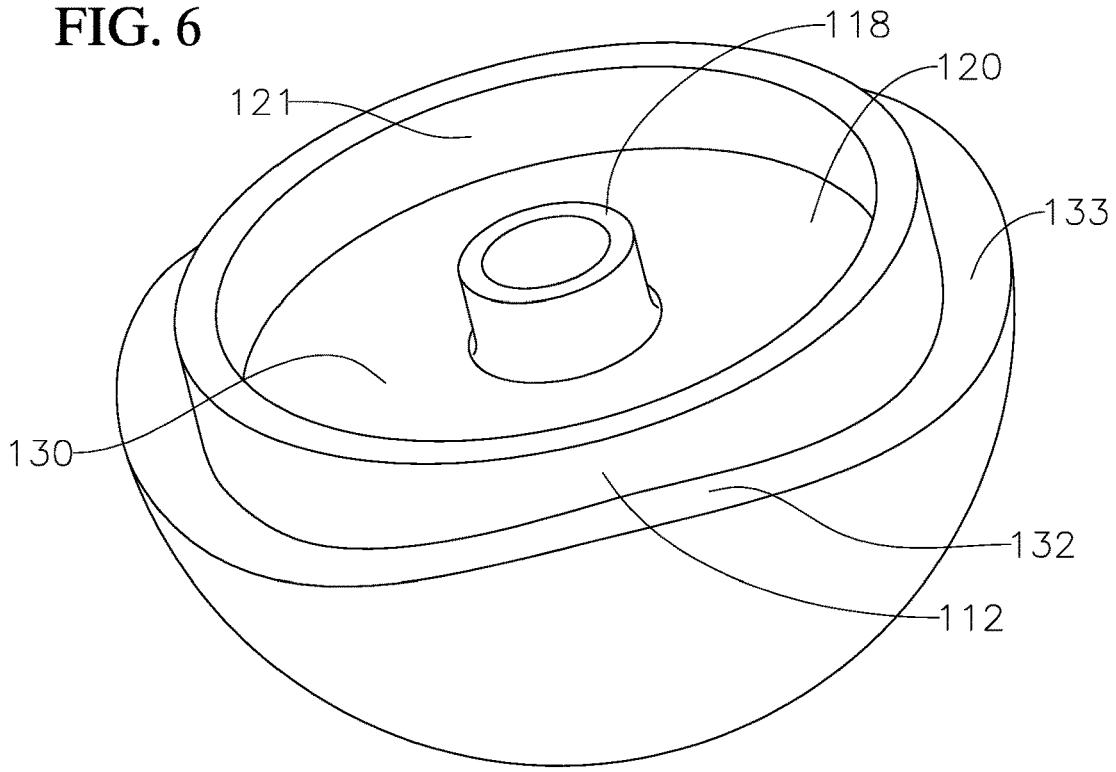
FIG. 6 is a top perspective view of the lower member of the tobacco bowl shown in FIG. 2.
Figure 7:
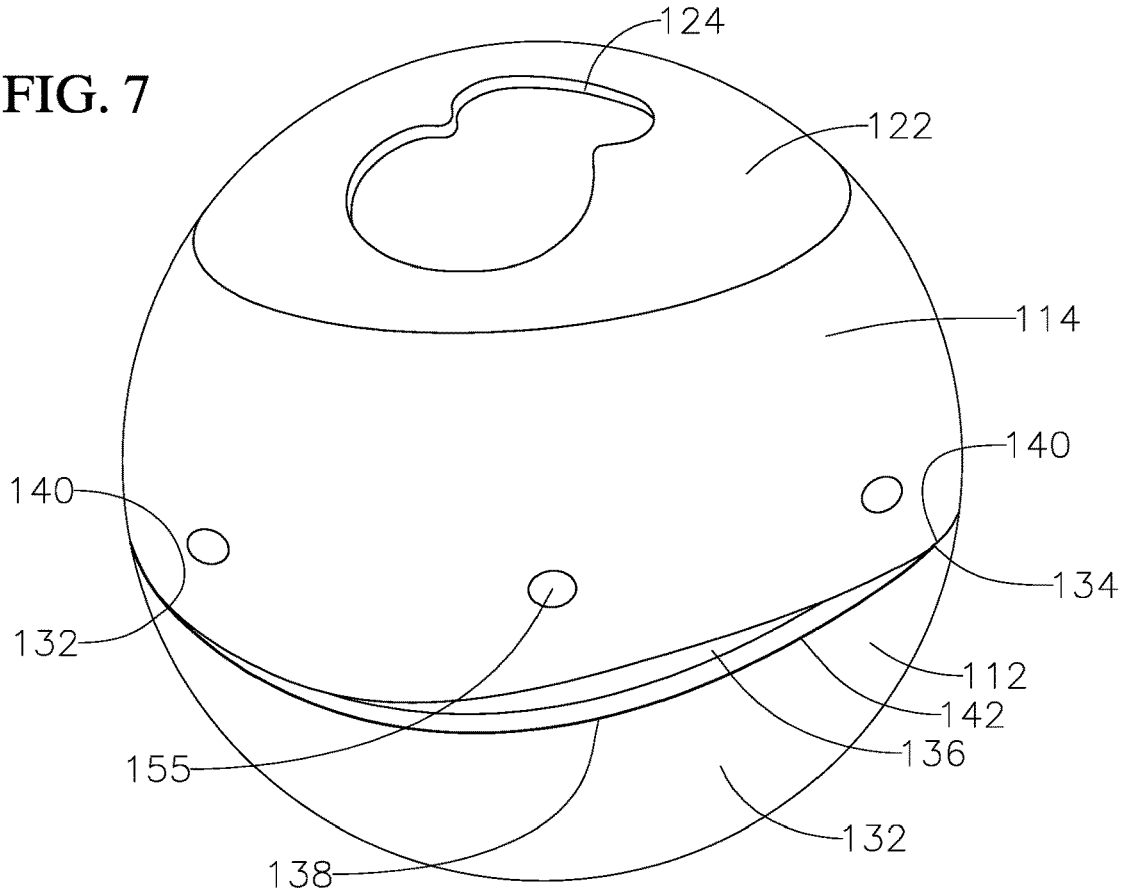
FIG. 7 is a side view of the tobacco bowl shown in FIG. 2 with its upper member rotated relative to its lower member such that the distance between the lower member tobacco receptacle and the coal plate is increased.

In an example embodiment, the lower member 112 includes an annular lip 132 defining a surface 133 extending along a generally sinusoidal path defining a plurality of peaks 134 and valleys 136, as for example shown in FIGS. 2 and 6. The upper member 114 also includes an annular lip 138 complementary to the lower member annular lip also defining a surface 139 extending along a sinusoidal path forming peaks 140 and valleys 142 such that the peaks of the lower member lip may be received in the valleys of the upper member lip and the peaks in the upper member lip may be received in the valleys of the lower member lip, as for example shown in FIG. 2. The upper member is mated over the lower member such that the upper member annular lip 138 rests on the lower member annular lip 132. Rotating the upper member relative to the lower member causes the lip of the upper member to ride on the lip of the lower member along the sinusoidal path of the lower lip. In this regard, as the peaks of the upper member annular lip slide up on the peaks of the annular lip of the lower member, the upper member rises relative to the lower member as for example shown in FIG. 7 such that the distance 144 between the base 130 of the tobacco receptacle 120 and the coal plate 126, as for example the upper surface 146 of the coal plate increases. Similarly, as the as the peaks of the upper member annular lip slide down into the valleys of the annular lip of the lower member, the upper member lowers relative to the lower member, as for example shown in FIG. 2. In this regard, by rotating the upper member relative to the lower member, the vertical distance of the coal plate and the tobacco receptacle base can be varied. In use, a smoker, may rotate the upper member relative to the lower member to reduce the distance between the coal plate and the receptacle and thus, the distance between the coals and the tobacco as the coals burn and wears out. In this regard as the heat generated by the coals decreases the coals are brought closer to the tobacco, such that the heat to which the tobacco is exposed is not reduced as much as if the distance between the coals and the tobacco was kept the same. During a smoking session, a user may rotate the upper member relative to the lower member at multiple intervals each time decreasing the distance between the coal plate and thus, the coals and the tobacco so as to continuously keeping the heat experienced by the tobacco relative constant and the coals burn out. Keeping the heat to which the tobacco is exposed to constant provides for a better smoking experience.

The amount of variance in the distance between the base 130 of the receptacle 120 and the coal plate 126 is a function of the depth of the valleys and/or the height of the peaks in each member.

In an example embodiment, the upper member is rested on the lower member and is removable from the lower member by lifting. When a cap 122 is provided it caps the second member above the coal plate, such that the cap will extend over the coals.

Figure 8:
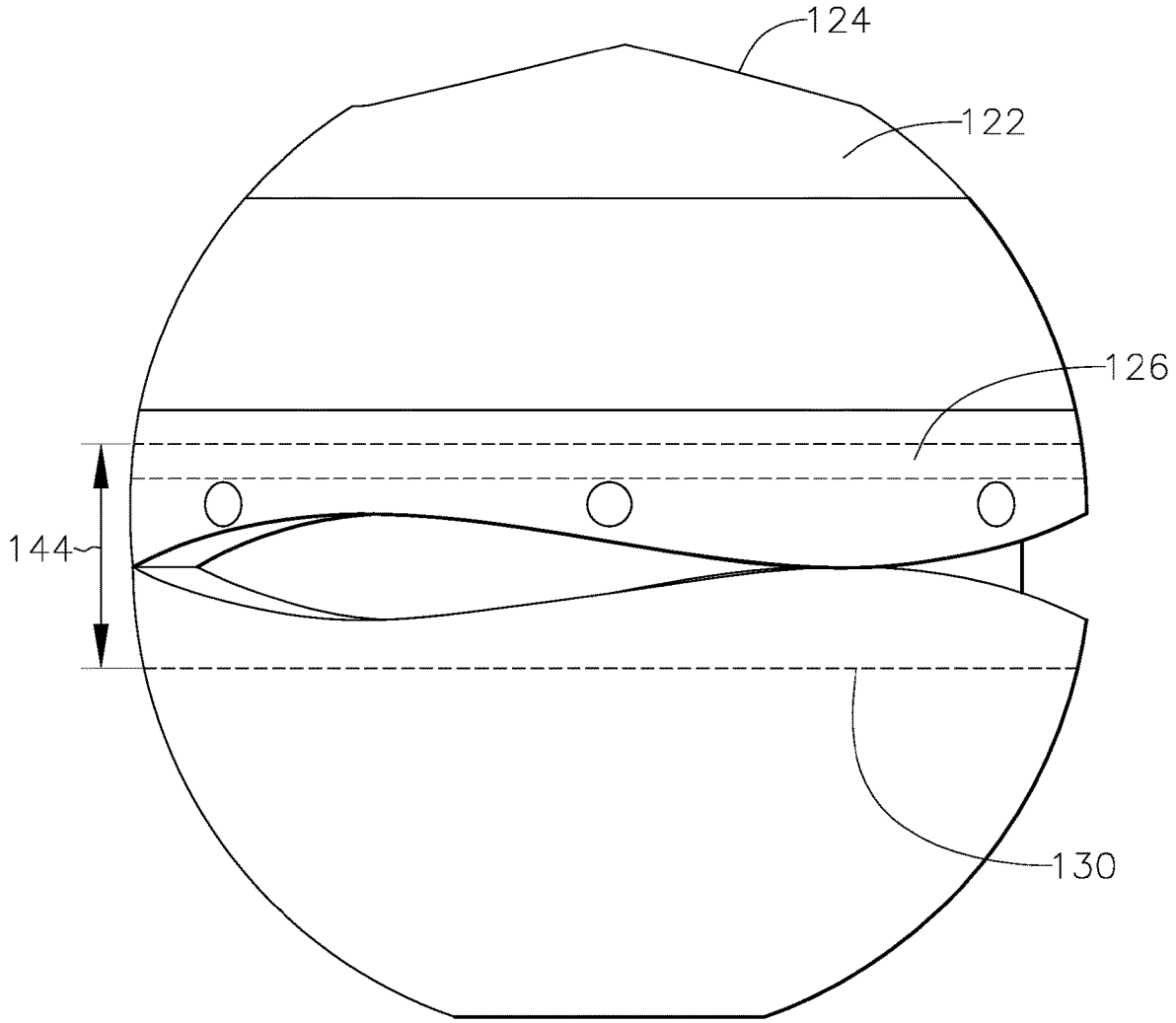
FIG. 8 is a front partial cross-sectional view of the example embodiment tobacco bowl shown in FIG. 1 with the distance between the base of the tobacco receptacle and the coal plate increased.

In other example embodiments instead of a sinusoidal path, the lips may follow a saw tooth path. In another example embodiment, the upper member is threaded to the lower member such that as the upper member is unthreaded from the lower member the distance of the coal plate from the receptacle 120 is increased. In any of the aforementioned exemplary embodiments, the upper member can rise relative to the lower member by at least 8 mm. In another exemplary embodiment, the upper member can rise relative to the lower member by at least 10 mm. In this regard, when the coals are freshly lit, the upper member is adjusted (e.g. rotated relative to the lower member) so as to increase the distance of the coal plate relative to the receptacle, as for example to the maximum distance 144, as for example shown in FIGS. 7 and 8 (e.g. an extended position). Once the coals wear by burning down, the coals can be brought closer to the tobacco as for example by further rotating the upper member relative to the lower member to reduce the distance between the receptacle and the coal plate up to the minimum distance 144 shown in FIG. 2 (e.g. a retracted position).

Figure 9:
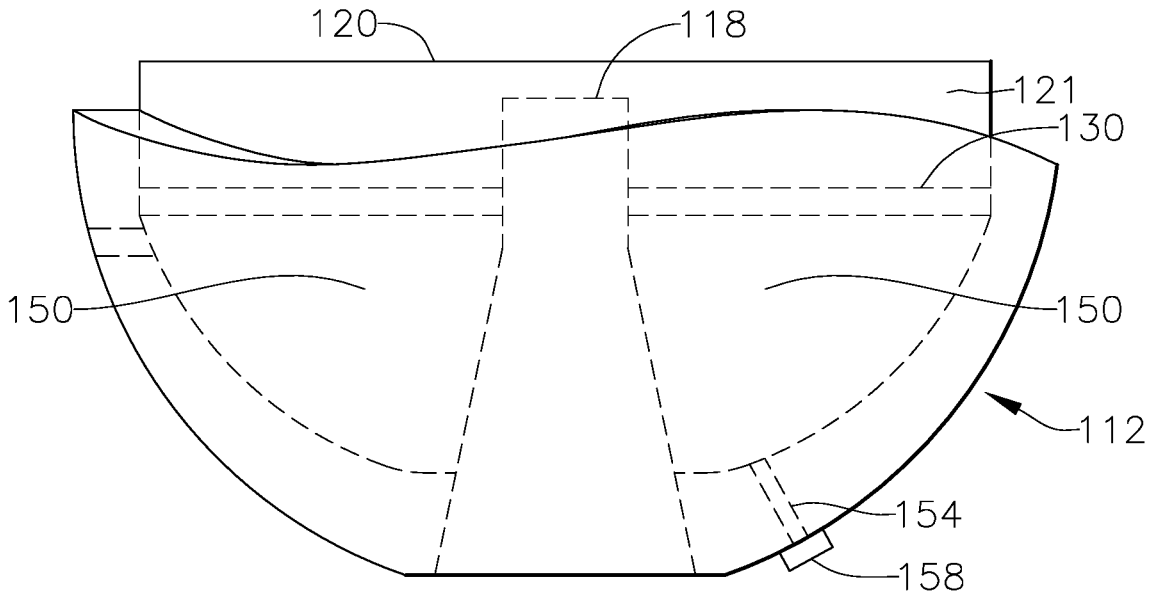
FIG. 9 is front partial cross-sectional view of the lower member including a reservoir.

In a further example embodiment, the lower member 112 may be formed with an inner reservoir 150, surrounding the conduit 118, as for example shown in FIG. 9. The opening forms an inlet allowing a user to fill the reservoir 150 with a coolant, such as water, or other fluids that can serve as coolants. The coolant serves to further cool the burning of the tobacco and provide for a smoother smoke. The coolant may be removed from the reservoir through the inlet 152. In other example embodiments and inlet and separate outlet are provided. In a further example embodiment, instead of inlet/outlet 152 an inlet 154 which may also serve as the outlet is formed through a bottom of the lower member 112. A cap 158 is provided to cap the inlet 154. In another example embodiment, instead of an inlet and or outlet, the lower member 112 may be formed as at two piece member comprising an upper portions including the receptacle 120 that mates (as for example via threading) with a lower portion that defines the reservoir 150.

While in the shown example embodiment, the tobacco bowl has a generally spherical outer shape, in other example embodiments, the tobacco bowl may have other outer shapes. Moreover the annular lips 132, 138 or the sinusoidal surfaces 133, 139 may are not formed extending to the outer surfaces of the upper and lower members 112, 114 as shown but may be formed in internal members that interact with each other for changing the distance between the coal plate and the base of the tobacco receptacle.

In an example embodiment, the upper member may include depressions or openings 155 for receiving tool, as for example, a pin or rod for lifting the upper member from the lower member, especially when the upper member is heated.

In an exemplary embodiment, the tobacco bowl is made from concreter or ceramic material that allows the outer surface of the tobacco bowl to remain cool to the touch allowing the user to adjust the location of the upper member relative to the lower member. In other example embodiments, the tobacco bowl may be made from other materials, such as silicone, that allow the outer surfaces of the tobacco bowl to be cool to the touch.

While this invention has been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. Although relative terms such as "outer," "inner," "upper," "lower," "below," "above," and similar terms have been used herein to describe a spatial relationship of one element to another, it is understood that these terms are intended to encompass different orientations of the various elements and components of the invention in addition to the orientation depicted in the figures. Additionally, as used herein, the term "generally," "about," and similar terms are used as terms of approximation and not as terms of degree, and are intended to account for the inherent deviations in measured or calculated values that would be recognized by those of ordinary skill in the art. Furthermore, as used herein, when a component is referred to as being "on" another component, it can be directly on the other component or components may also be present therebetween. Moreover, when a component is component is referred to as being "coupled" to another component, it can be directly attached to the other component or intervening components may be present therebetween.

What is claimed is:

1. A tobacco bowl comprising:

a first member having a tobacco receptacle for receiving tobacco;

a second member over the first member; and a coal plate for supporting a coal, the coal plate being on the second member, wherein the second member is moveable relative to the first member for adjusting a vertical distance between the coal plate and the tobacco receptacle for adjusting a distance between the coal and the tobacco during use, wherein the first member comprises a first surface comprising peaks and valleys, wherein the second member comprises a second surface comprising peaks and valleys, and wherein rotation of the second member relative to the first member causes the peaks of the second surface to ride on the peaks of the first surface causing the second member to move in a direction away from the first member and the distance between the coal plate the tobacco receptacle to increase or causes the peaks of the second surface to ride in the valleys of the first surface causing the second member to move toward the first member and the distance between the coal plate and the tobacco receptacle to decrease.

2. The tobacco bowl of claim 1, wherein each of the first and second surfaces extends along a sinusoidal path.

3. The tobacco bowl of claim 1, wherein each of the first and second surfaces extends along a sawtooth path.

4. The tobacco bowl of claim 1, wherein the first surface extends to an outer surface of the first member and the second surface extends to an outer surface of the second member.

5. The tobacco bowl of claim 1, wherein the first surface is defined on a lip of the first member and wherein the second surface is defined on a lip of the second member.

6. The tobacco bowl of claim 1, further comprising a reservoir defined in the first member for receiving a coolant.

7. A hookah comprising:

a liquid reservoir;

a stem extending in the liquid reservoir;

a hose extending into the liquid reservoir; and a tobacco bowl extending from the stem externally of the liquid reservoir, said tobacco bowl comprising, a first member having a tobacco receptacle for receiving tobacco, a second member over the first member, and coal plate for supporting a coal, said coal plate being on the second member, wherein the second member is moveable relative to the first member for adjusting a vertical distance between the coal plate and the tobacco receptacle for adjusting a distance between the coal and the tobacco during use, wherein the first member comprises a first surface comprising peaks and valleys, wherein the second member comprises a second surface comprising peaks and valleys, and wherein rotation of the second member relative to the first member causes the peaks of the second surface to ride on the peaks of the first surface causing the second member to move in a direction away from the first member and the distance between the coal plate the tobacco receptacle to increase or causes the peaks of the second surface to ride in the valleys of the first surface causing the second member to move toward the first member and the distance between the coal plate and the tobacco receptacle to decrease.

8. The hookah of claim 7, wherein each of the first and second surfaces extends along a sinusoidal path.

9. The hookah of claim 7, wherein each of the first and second surfaces extends along a sawtooth path.

10. The hookah of claim 7, wherein the first surface extends to an outer surface of the first member and the second surface extends to an outer surface of the second member.

11. The hookah of claim 7, wherein the first surface is defined on a lip of the first member and wherein the second surface is defined on a lip of the second member.

12. The hookah of claim 7, further comprising a reservoir defined in the first member for receiving a coolant.

13. A method of using a hookah comprising a tobacco bowl comprising a first member having a tobacco receptacle containing tobacco therein, and a second member over the first member, the second member having a coal plate supporting a coal, the method comprising adjusting a distance of the coal to the tobacco by moving the second member relative to the first member, wherein moving the second member relative to the first member comprises rotating the second member relative to the first member, wherein the first member comprises a first surface, wherein the second member comprises a second surface, wherein the first surface comprises a plurality of peaks and valleys and the second surface comprises a plurality of peaks and valleys, and wherein rotating the second member relative to the first member causes the peaks of the second surface to ride on the peaks of the first surface causing the second member to move in a direction away from the first member and the distance between the coal and the tobacco to increase or causes the peaks of the second surface to ride in the valleys of the first surface causing the second member to move toward the first member and the distance between the coal and the tobacco receptacle to decrease.

14. The method of claim 13, further comprising, filling a reservoir defined in the first member with a coolant.

15. A tobacco bowl comprising:

a first member having a tobacco receptacle for receiving tobacco, said first member defining a first outer surface of said tobacco bowl extending around an entire perimeter of said tobacco bowl;

a second member over the first member, said second member defining a second outer surface of said tobacco bowl extending around an entire perimeter of said tobacco bowl; and a coal plate for supporting a coal, the coal plate being on the second member, wherein the second member is rotatable relative to the first member for adjusting a vertical distance between the coal plate and the tobacco receptacle for adjusting a distance between the coal and the tobacco during use, wherein the first member comprises a first surface and wherein the second member comprises a second surface, wherein at least one of the first and second surfaces has at least a peak and at least a valley, and wherein rotation of the second member relative to the first member causes the other of the first and second surfaces to ride on said at least a peak or said at least a valley for moving the first member relative to the second member for adjusting said vertical distance.

16. The tobacco bowl of claim 15, further comprising a reservoir defined in the first member for receiving a coolant.

17. A hookah comprising:

a liquid reservoir;

a stem extending in the liquid reservoir;

a hose extending into the liquid reservoir; and a tobacco bowl extending from the stem externally of the liquid reservoir, said tobacco bowl comprising, a first member having a tobacco receptacle for receiving tobacco, said first member defining a first outer surface of said tobacco bowl extending around an entire perimeter of said tobacco bowl, a second member over the first member, said second member defining a second outer surface of said tobacco bowl extending around an entire perimeter of said tobacco bowl, and coal plate for supporting a coal, said coal plate being on the second member, wherein the second member is rotatable relative to the first member for adjusting a vertical distance between the coal plate and the tobacco receptacle for adjusting a distance between the coal and the tobacco during use, wherein the first member comprises a first surface and wherein the second member comprises a second surface, wherein at least one of the first and second surfaces has at least a peak and at least a valley, and wherein rotation of the second member relative to the first member causes the other of the first and second surfaces to ride on said at least a peak or said at least a valley for moving the first member relative to the second member for adjusting said vertical distance.

18. The hookah of claim 17, further comprising a reservoir defined in the first member for receiving a coolant.

19. A method of using a hookah comprising a tobacco bowl comprising a first member having a tobacco receptacle containing tobacco therein, and a second member over the first member, the second member having a coal plate supporting a coal, wherein said first member defines a first outer surface of said tobacco bowl extending around an entire perimeter of said tobacco bowl, and said second member defines a second outer surface of said tobacco bowl extending around an entire perimeter of the tobacco bowl, the method comprising adjusting a distance of the coal to the tobacco by moving the second member relative to the first member, wherein moving the second member relative to the first member comprises rotating the second member relative to the first member, wherein the first member comprises a first surface, wherein the second member comprises a second surface, wherein at least one of the first surface and the second surfaces comprises at least a peak and at least a valley, and wherein rotating the second member relative to the first member causes the other of the first and the second surfaces to ride on said at least a peak or said at least a valley for adjusting said distance.

20. The method of claim 19, further comprising, filling a reservoir defined in the first member with a coolant.

* * * * *